US008053060B2

(12) United States Patent
Fujisawa et al.

(10) Patent No.: US 8,053,060 B2
(45) Date of Patent: Nov. 8, 2011

(54) BASE MATERIAL FOR ARTIFICIAL LEATHERS AND METHOD OF PRODUCING THE SAME

(75) Inventors: Michinori Fujisawa, Kurashiki (JP); Jiro Tanaka, Kurashiki (JP); Yoshiyuki Ando, Kurashiki (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 997 days.

(21) Appl. No.: 11/917,665

(22) PCT Filed: Jun. 14, 2006

(86) PCT No.: PCT/JP2006/311925

§ 371 (c)(1), (2), (4) Date: Dec. 14, 2007

(87) PCT Pub. No.: WO2006/134966

PCT Pub. Date: Dec. 21, 2006

(65) Prior Publication Data

US 2009/0087618 A1 Apr. 2, 2009

(30) Foreign Application Priority Data

Jun. 17, 2005 (JP) ..... 2005-178195

(51) Int. Cl.

| | |
|---|---|
| ***D06N 7/04*** | (2006.01) |
| ***B32B 27/04*** | (2006.01) |
| ***B32B 27/12*** | (2006.01) |
| ***B32B 5/02*** | (2006.01) |

(52) U.S. Cl. ..... 428/151; 422/105; 422/340; 422/361; 422/363; 422/402

(58) Field of Classification Search ..... 428/151; 442/105, 340, 361, 363, 402

See application file for complete search history.

(56) References Cited

U.S. PATENT DOCUMENTS 4,651,393 A 3/1987 Dilo et al.

(Continued)

FOREIGN PATENT DOCUMENTS

DE 3444763 A1 6/1986

(Continued)

OTHER PUBLICATIONS

U.S. Appl. No. 12/593,399, filed Sep. 28, 2009, Tanaka, et al.

(Continued)

*Primary Examiner* — Norca L Torres Velazquez

(74) *Attorney, Agent, or Firm* — Oblon, Spivak, McClelland, Maier & Neustadt, L.L.P.

(57) ABSTRACT

A substrate for artificial leathers which is composed of a nonwoven fabric made of fiber bundles of microfine fibers having an average single fiber fineness of 0.5 dtex or less and an elastic polymer impregnated into the nonwoven fabric. The substrate for artificial leathers satisfies the following requirements 1 and 2: (1) the number of fiber bundles which are oriented to a thickness direction of the nonwoven fabric is 75 to 300 per 1 cm of width which is perpendicular to the thickness direction, when measured on a cross section parallel to the thickness direction; and (2) the number of cross sections of the fiber bundles which are oriented to the thickness direction is 30 to 800 per 1 $mm^2$, when measured on a cross section perpendicular to the thickness direction. The substrate for artificial leathers is suitable for the production of a grain-finished artificial leather which combines a non-repulsive softness and firm hand resembling natural sheep leathers and has fine buckling wrinkles, and a suede-finished or nubuck artificial leather having a surface touch with fine texture and a grace writing effect each being hitherto not obtained.

18 Claims, 2 Drawing Sheets

U.S. PATENT DOCUMENTS

| | | | | |
|---|---|---|---|---|
| 4,656,081 | A * | 4/1987 | Ando et al. | 442/235 |
| 6,716,776 | B2 * | 4/2004 | Morishima et al. | 442/104 |
| 2007/0231547 | A1 * | 10/2007 | Makimura et al. | 428/151 |

FOREIGN PATENT DOCUMENTS

| | | | |
|---|---|---|---|
| DE | 101 62 463 | A1 | 7/2003 |
| JP | 11 181632 | | 7/1999 |
| JP | 2000 273769 | | 10/2000 |
| JP | 2001 192976 | | 7/2001 |
| JP | 2002 317387 | | 10/2002 |
| WO | 99 11853 | | 3/1999 |

OTHER PUBLICATIONS

Richard Dilo, "Vernadelungstechnologien gestern—heute—morgen", Melliand Textilberichte, Deutscher Fachverlag, vol. 59, Jan. 1, 1978, XP009129094, pp. 278-281.

U.S. Appl. No. 12/097,659, filed Jun. 16, 2008, Fujisawa, et al.

U.S. Appl. No. 12/302,813, filed Dec. 1, 2008, Fujisawa, et al.

U.S. Appl. No. 12/161,013, filed Jul. 16, 2008, Fujisawa, et al.

* cited by examiner

BASE MATERIAL FOR ARTIFICIAL LEATHERS AND METHOD OF PRODUCING THE SAME

TECHNICAL FIELD

The present invention relates to a substrate for artificial leathers which is composed of a nonwoven fabric made of bundles of microfine fibers and an elastic polymer impregnated into the nonwoven fabric. More specifically, the present invention relates to a substrate for artificial leathers having both a non-repulsive softness and a firm hand each resembling those of tanned sheep skin clothes, which can be used in the production of grain-finished artificial leathers having fine buckling wrinkles and nubuck artificial leathers having a surface touch with fine texture and having a grace writing effect.

BACKGROUND ART

Artificial leathers have come to be widely used in the fields of clothes, general materials, sports, etc. because their light weights and easiness of handling have been accepted by consumers. In such application fields, high-quality artificial leathers which meet both the sensory feeling such as appearance and hand and the physical properties such as dimension stability are required. Artificial leathers excellent in appearance, hand, etc. are generally produced by a method including the conversion of microfine fiber-forming fibers into microfine fibers by removing one component therein. A generally known method of producing artificial leathers which includes the conversion of fibers into microfine fibers are roughly composed of a step (1) in which microfine fiber-forming fibers made of two kinds of polymers having different solubilities are made into staple fibers, a step (2) in which the staples fibers are formed into a web by using a carding machine, crosslapper, random webber, etc., a step (3) in which the fibers are entangled to one another by a needle-punching, etc. to form an entangled nonwoven fabric, a step (4) in which a solution or emulsion of an elastic polymer such as polyurethane is impregnated into the entangled nonwoven fabric and coagulated, and a step (5) in which the microfine fiber-forming fibers are converted into microfine fibers by removing one of their components. The step (4) and step (5) may be carried out in reverse order. By such production methods, soft artificial leathers composed of microfine fibers are obtained.

Unlike a method of using short fibers, a method of using long fibers does not need a series of large apparatuses such as a raw fiber feeder, an apparatus for opening fibers, a carding machine and a cross lay machine. In addition, a nonwoven fabric made of long fibers is advantageous to a nonwoven fabric made of short fibers because of its high strength.

Nonwoven fabrics of long microfine fibers have been mainly produced by a method in which microfine fiber-forming long fibers (also referred to as "composite long fiber") composed of two or more kinds of incompatible polymers are made into a nonwoven fabric and then the microfine fiber-forming long fibers are converted into microfine fibers by splitting and dividing along the lengthwise direction through the interface between the polymers. However, it is very difficult to split or divide uniformly. Therefore, the obtained nonwoven fabric of long microfine fibers is mainly used in the production of grain-finished artificial leathers, and a nonwoven fabric of long microfine fibers which is applicable to the production of suede-finished artificial leathers is difficult to obtain.

Many artificial leathers having a softness like natural leathers have been proposed. One example thereof is produced by impregnating a polyurethane resin into an entangled nonwoven fabric of sea-island fibers, wet-coagulating the polyurethane resin, converting the sea-island fibers into bundles of microfine fibers with 0.2 D or less by removing the sea component by extraction with a solvent to obtain a substrate, applying a polyurethane solution on the surface of the substrate, wet-coagulating the polyurethane, and then gravure-coating a coloring composition to color the polyurethane resin (Patent Document 1). Although the proposed natural leather-like sheet has a flexibility which resembles that of natural leathers, a grain-finished artificial leather which combines the non-repulsive softness and firm hand each resembling those of natural sheep skins and fine buckling wrinkles have not yet been obtained.

Further proposed is an artificial leather having a flexible and dense feeling (firm texture) which is produced by impregnating a high-density nonwoven fabric with a resin in an amount smaller than usual (Patent Document 2). However, the proposed artificial leather has a surface with a poor softness and a low interlaminar strength. Therefore, it is insufficient as the material for support shoes which are used under severe conditions.

Still further proposed is a grain-finished artificial leather made of a nonwoven fabric of long fibers (Patent Document 3). In Patent Document 3, it is described that the strain markedly caused during the entangling treatment of long fibers can be relieved by intendedly cut the long fibers during the entangling treatment by needle punching, thereby exposing the cut ends of fibers to the surface of the nonwoven fabric in a density of 5 to 100/mm$^2$. It is also described that 5 to 70 fiber bundles are present per 1 cm width on the cross section parallel to the thickness direction of the nonwoven fabric of long fibers, i.e., the number of fiber bundles which are oriented by needle punching in the thickness direction is 5 to 70 per 1 cm width of the cross section. It is further described that the total area of fiber bundles on an arbitrary cross section perpendicular to the thickness direction of the nonwoven fabric of long fibers is 5 to 70% of the cross-sectional area. Although cutting the long fibers to an extent achieving the intended properties, many long fibers are required to be cut to make the nonwoven fabric of long fibers into the proposed structure. Therefore, the advantages of using long fibers that the strength of nonwoven fabric is enhanced because of their continuity are significantly reduced, thereby failing to effectively use their advantages. To cut the fibers on the surface of nonwoven fabric evenly, the entangling treatment should be performed by repeating the needle punching many times under conditions severer than usual, thereby making it difficult to obtain the high-quality structure of long-fiber nonwoven fabric aimed in the present invention.

Patent Document 1: JP 63-5518B (pages 2-4)
Patent Document 2: JP 4-185777A (pages 2-3)
Patent Document 3: JP 2000-273769A (pages 3-5)

DISCLOSURE OF THE INVENTION

An object of the present invention is to provide a substrate for artificial leathers capable of being produced from various combinations of microfine fibers and elastic polymers, providing grain-finished artificial leathers which combine a non-repulsive softness and a firm hand like natural sheep leathers and have fine buckling wrinkles and providing suede-finished or nubuck artificial leathers which have a surface touch with fine texture and grace writing effect not found in the known artificial leathers. Another object is to provide a method of producing the substrate for artificial leathers.

As a result of extensive research, the inventors have found the substrate for artificial leathers which achieves the above objects, to accomplish the present invention. Thus, the present invention relates to a substrate for artificial leathers which is composed of a nonwoven fabric made of bundles of microfine fibers having an average single fiber fineness of 0.5 dtex or less and an elastic polymer impregnated into the nonwoven fabric, the substrate satisfying the following requirements 1 and 2: (1) the number of fiber bundles which are oriented to a thickness direction of the nonwoven fabric is 75 to 300 per 1 cm of width, when measured on a cross section parallel to the thickness direction; and (2) the number of fiber bundles which are oriented to the thickness direction is 30 to 800 per 1 $mm^2$, when measured on a cross section perpendicular to the thickness direction.

The present invention also relates to a grain-finished artificial leather which is composed of the substrate for artificial leathers and a coating layer formed on at lease one surface of the substrate, and a suede-finished artificial leather which is composed of the substrate for artificial leathers having at least one surface thereof raised.

The present invention further relates to a method of producing a substrate for artificial leathers, which includes:

(1) a step of forming a fiber web from microfine fiber-forming fibers which are capable of being converted into microfine fibers having an average single fiber fineness of 0.5 dtex or less;

(2) a step of needle-punching the fiber web while holding the microfine fiber-forming fibers outwardly projecting from the fiber web in a brush on a brush belt which is disposed so that a tip of the brush comes into contact with at least one surface of the fiber web, thereby obtaining an entangled nonwoven fabric;

(3) a step of impregnating an elastic polymer into the entangled nonwoven fabric; and (4) a step of converting the microfine fiber-forming fibers to fiber bundles of microfine fibers having an average single fiber fineness of 0.5 dtex or less.

BEST MODE FOR CARRYING OUT THE INVENTION

Figure 1:
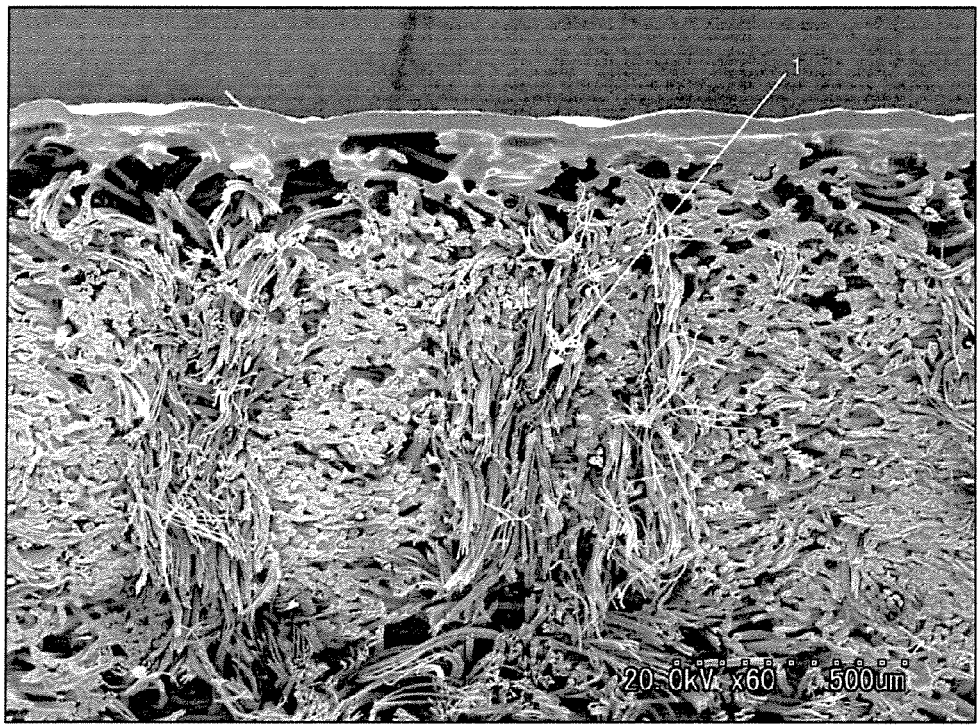
FIG. 1 is an electron photomicrograph (×60) of a cross section which is taken along a direction parallel to the thickness direction of a grain-finished artificial leather made of the substrate for artificial leathers of the invention, showing the orientation of the fiber bundles in the nonwoven fabric to the thickness direction.

The microfine fibers which constitute the substrate for artificial leathers of the invention are made by converting composite fibers (microfine fiber-forming fibers) into microfine fibers. The composite fibers are composed of at least two kinds of spinnable polymers which are chemically or physically different from one another. The conversion is performed at an appropriate stage before or after the impregnation of an elastic polymer by the extractive removal of at least one kind of polymer. Examples of the microfine fiber-forming fibers include composite fibers such as sea-island fibers, multilayered fibers, radially laminated fibers, which are produced by a chip blend (mix spinning) method, conjugated spinning method, etc. Preferred are sea-island fibers because the damage during needle punching is small and uniform microfine fibers are obtained.

As the island component polymer for the sea-island fibers, preferably usable are fiber-forming polymers, for example, polyester resins such as polyethylene terephthalate (PET), polytrimethylene terephthalate (PTT), polybutylene terephthalate (PBT) and polyester elastomers; polyamide resins such as nylon 6, nylon 66, nylon 610, nylon 12, aromatic polyamides and polyamide elastomers; polyurethane resins; and polyolefin resins, with the polyester resins such as PET, PTT and PBT being particularly preferred because of their easiness of shrinking, good hand of final products and high performance in use. The melting point of the island component polymer is preferably 160° C. or higher in view of dimension stability and performance in use. More preferred are fiber-forming crystallizable resins having a melting point of 180 to 250° C. The method for measuring the melting point will be described below. The resin for constituting the microfine fibers may be added with a colorant such as dye and pigment, an ultraviolet absorber, a heat stabilizer, a deodorant, a fungicide, and stabilizers.

The sea component polymer for the sea-island fibers is not specifically limited and preferably a polymer which is different from the island component polymer in the solubility and decomposability, less compatible with the island component polymer, and has a melt viscosity or surface tension smaller than those of the island polymer under the spinning conditions. For example, at least one polymer selected from polyethylene, polypropylene, polystyrene, ethylene-propylene copolymers, ethylene-vinyl acetate copolymers, styrene-ethylene copolymers, styrene-acryl copolymers and polyvinyl alcohol resins is used as the sea component polymer. Taking the capability of producing the substrate for artificial leathers without using chemicals, the spinnability of sea-island fibers, the needle punchability, the prevention of environmental pollution, and the easiness of removal into consideration collectively, a water-soluble, thermoplastic polyvinyl alcohol-based resin (PVA-based resin) is preferably used as the sea component polymer.

The viscosity average polymerization degree (hereinafter merely referred to as "polymerization degree") of PVA-based resin is preferably 200 to 500, more preferably 230 to 470, and still more preferably 250 to 450. If being 200 or more, the melt viscosity is moderately high, and the PVA-based resin is stably made into a composite with the island component. If being 500 or less, the melt viscosity is not excessively high and the extrusion from a spinning nozzle is easy. By using a PVA-based resin having a polymerization degree of 500 or less, i.e., a low-polymerization degree PVA, the dissolution to a hot water becomes quick.

The polymerization degree (P) is measured according to JIS-K6726, in which a PVA-based resin is re-saponified and purified, and then, an intrinsic viscosity [η] is measured in water of 30° C. The polymerization degree (P) is calculated from the following equation:

$$P([\eta]10^{3}/8.29)^{(1/0.62)}.$$

The saponification degree of the PVA-based resin is preferably 90 to 99.99 mol %, more preferably 93 to 99.98 mol %, still more preferably 94 to 99.97 mol %, and particularly preferably 96 to 99.96 mol %. If being 90 mol % or more, the melt spinning is performed without causing thermal decomposition and gelation because of a good heat stability and the biodegradability is good. Also, suitable composite fibers can be obtained without decreasing the water solubility even when modified with a copolymerizable monomer which will be described below. PVA having a saponification degree exceeding 99.99 mol % is difficult to produce stably.

The PVA-based resin is biodegradable and decomposed to water and carbon dioxide by an activated sludge treatment or by being laid underground. It is preferred to treat a PVA-containing waste water, which is resulted from the removal of the PVA resin by dissolution, by activated sludge. The PVA resin is completely decomposed within a period of from two days to one month when the PVA-containing waste water is continuously treated by activated sludge. Since the combustion heat is low to impose little load of heat to an incinerator, the PVA resin may be incinerated after drying the PVA-containing waste water.

The melting point of PVA resin (Tm) is preferably 160 to 230° C., more preferably 170 to 227° C., still more preferably 175 to 224° C., and particularly preferably 180 to 220° C. If being 160 ° C. or higher, the crystallizability is sufficient to enhance the fiber strength and the heat stability is good to make the fiber formation easy. If being 230° C. or lower, the composite fibers can be stably produced because the melt spinning can be performed at low temperatures, thereby increasing the difference between the melt-spinning temperature and the decomposition temperature of PVA-based resin. The measuring method of the melting point will be described below.

The PVA-based resin is produced by saponifying a resin mainly constituted by vinyl ester units. Examples of vinyl monomers for the vinyl ester units include vinyl formate, vinyl acetate, vinyl propionate, vinyl valerate, vinyl caprate, vinyl laurate, vinyl stearate, vinyl benzoate, vinyl pivalate and vinyl versatate, with vinyl acetate being preferred in view of easiness of production of the PVA-based resin.

The PVA-based resin may be homo PVA or modified PVA introduced with co-monomer units, with the modified PVA being preferred in view of a good melt spinnability, water solubility and fiber properties. In view of a good copolymerizability, melt spinnability and water solubility, preferred examples of the co-monomers are α-olefins having 4 or less carbon atoms such as ethylene, propylene, 1-butene and isobutene; and vinyl ethers such as methyl vinyl ether, ethyl vinyl ether, n-propyl vinyl ether, isopropyl vinyl ether and n-butyl vinyl ether. The content of the comonomer units in PVA is preferably 1 to 20 mol %, more preferably 4 to 15 mol %, and still more preferably 6 to 13 mol % base on the total constitutional units in the modified PVA. Particularly preferred is ethylene-modified PVA, because the fiber properties are enhanced when the comonomer unit is ethylene. The content of the ethylene units is preferably 4 to 15 mol % and more preferably 6 to 13 mol %.

The PVA-based resin can be produced by a known method such as bulk polymerization, solution polymerization, suspension polymerization, and emulsion polymerization. Generally, a bulk polymerization or solution polymerization in the absence of solvent or in the presence of a solvent such as alcohol are employed. Examples of the solution for the solution polymerization include lower alcohols such as methyl alcohol, ethyl alcohol and propyl alcohol. The copolymerization is performed in the presence of a known initiator, for example, an azo initiator or peroxide initiator such as a,a'-azobisisobutyronitrile, 2,2'-azobis(2,4-dimethyl-vareloni-trile), benzoyl peroxide, and n-propyl peroxycarbonate. The polymerization temperature is not critical and a range of from 0 to 150° C. is recommended.

Since the fiber web made of the composite fibers containing the PVA-based resin as the removable component and the heat-shrinkable resin as the microfine fiber-forming component is balky, the nonwoven fabric hardly grows rigid and coarse because of the damages of fibers caused during the needle punching. When containing a small amount of water, the PVA-based resin is plasticized in some extent. When letting the composite fibers shrink by the heat treatment in the plasticized state, the nonwoven fabric easily and stably become dense. By impregnating an aqueous emulsion of elastic polymer into a highly dense nonwoven fabric at low temperatures so as to prevent the PVA-based resin from dissolving to water, and then, converting the composite fibers to microfine fibers by removing the PVA-based resin with water, interstices are formed between the microfine fibers and the elastic polymer. Thus, the substrate for artificial leathers can be made densified and flexible at the same time. The artificial leathers made of the substrate for artificial leathers produced in such manner acquire a drapeability and a hand closely resembling those of natural leathers.

When the microfine fiber-forming fibers (composite fibers) are sea-island fibers, the content of the sea component in the fibers is preferably 5 to 70% by mass, more preferably 10 to 60% by mass, and still more preferably 15 to 50% by mass. If the content is 5% by mass or more, the composite fibers are stably spun. In addition, since the removable component is contained in a sufficient amount, a sufficient amount of interstices is formed between the microfine fibers and the elastic polymer, to provide artificial leathers with good flexibility. If the content is 70% by mass or less, a large amount of the elastic polymer is not required, although a large amount of the elastic polymer is required for stabilizing the shape of artificial leathers when the removable component is excessively contained. Also, as described above, an excessively large amount of water is not required to plasticize the PVA-based resin in the step of shrinking the composite fibers. Therefore, the drying operation needs a small amount of heat, to enhance the productivity. In addition, an insufficient shrink and a place-to-place uneven shrink do not occur, to make the quality stable.

Like the known method of producing the substrate for artificial leathers, the drawn microfine fiber-forming fibers having a desired fineness may be cut to staples having a desired length after crimped and then the staples may be made into a fiber web by a carding machine, crosslapper or random webber. However, in the present invention, the microfine fiber-forming fibers are preferably made into a long fiber web without being cut to staples by a spun bond method which is directly combined with the melt spinning operation. For example, microfine fiber-forming fibers extruded from a spinning nozzle are cooled by a cooling apparatus, drawn to an intended fineness by air jet at a speed corresponding to a take-up speed of 1000 to 6000 m/min using a sucking apparatus such as an air jet nozzle, and then collected on a moving surface while opening the fibers. After partially pressing the collected long fibers to stabilize the shape, if needed, a long fiber web is obtained. In view of easiness of handling in the process, the fineness of the long fiber for forming microfine fibers is preferably from 1 to 5 dtex and the mass per unit area is preferably from 20 to 500 g/m$^2$. It is preferred to regulate the number of islands such that the average single fiber fineness of the resultant microfine long fibers falls within a range preferably from 0.0003 to 0.5 dtex and more preferably from 0.001 to 0.2 dtex, because a leather-like sheet excellent in the flexibility and appearance and a suede-finished leather-like sheet having a good dyeability are obtained. The average single fiber fineness of the microfine long fibers constituting the suede-finished artificial leather can be determined, for example, by observing the cross section or surface of the suede-finished artificial leather under a transmission electron microscope. This method of producing long fiber webs is advantageous in productivity, because it does not need a series of large apparatuses such as a raw fiber feeder, an apparatus for opening fibers and a carding machine which are necessarily used in the production method of short fiber webs. In addition, since the long-fiber nonwoven fabric and the substrate for artificial leathers made thereof are constituted by long fibers with high continuity, the properties thereof such as strength are high as compared with those of the short-fiber nonwoven fabric and the substrate for artificial leathers made thereof which have been hitherto generally used. The mass per unit area of the long fiber web is preferably 20 to 500 g/m$^2$ in view of easiness of handling and stability of quality.

In case of using short fibers, the fineness, fiber length and crimp are limited to the extent which is applicable to an apparatus for opening fibers, a carding machine, etc. For example, the fineness is limited to 2 dtex or more, and 3 to 6 dtex is generally employed in view of stability. In contrast, in case of using long fibers, there is substantially no limitation by the apparatus. The fineness can be selected from a wide range of about 0.5 dtex or more, or 1 to 10 dtex even in taking the handling properties in subsequent steps into consideration. In view of the properties and hand of the resultant substrate for artificial leathers, the average single fiber fineness of the microfine fiber-forming long fibers is preferably 1 to 5 dtex. The fineness, shape of cross section, content of removable component of the microfine fiber-forming fibers are preferably controlled so as to obtain the microfine fibers having an average single fiber fineness of 0.0003 to 0.5 dtex.

Figure 3:
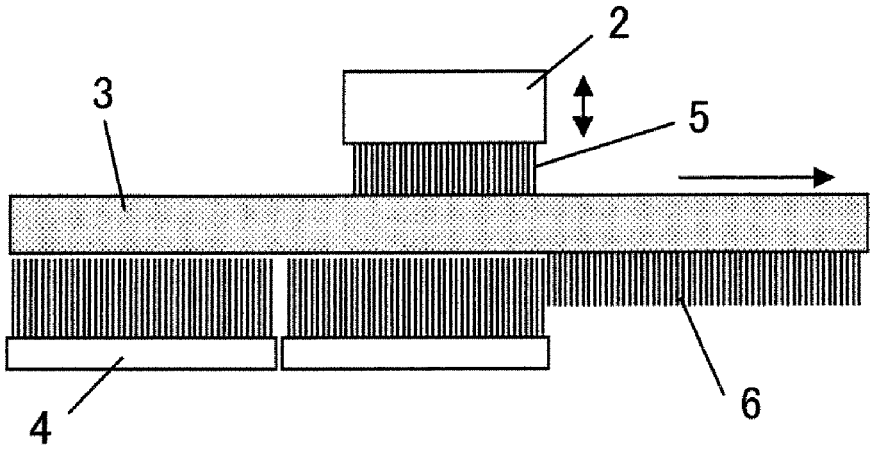
FIG. 3 is a schematic side view of a velour needle machine usable in the present invention.

The fiber web, preferably long fiber web thus produced are, after stacked two or more if necessary, made into an entangled nonwoven fabric by an entangling treatment including a needle punching mentioned below without cutting the fibers (microfine fiber-forming fibers) as much as possible while orienting the fibers in the thickness direction and entangling the fibers. The needle punching operation of the present invention is at least partly conducted by a needle punching method as shown in FIG. 3, in which a brush belt 4 is disposed so as to allow the brush to come into contact with one surface (raising surface) of a fiber web 3 and the fiber web 3 is punched from the opposite surface (punching surface) with needles 5 having one or more barbs which are embedded in a needle board of a needle punching machine 2. The punching is performed in a depth so that at least one barb of each needle is allowed to pass through the fiber web 3, and the outwardly projecting fibers from the fiber web are held in the brush belt 4. The brush belt 4 is preferably an endless belt having thereon brushes having a length longer than the projecting length of the fibers which outwardly project in loop form from the fiber web 3. At least in the needle punching section, the brush belt 4 is disposed so as to move together with the fiber web 3 in the same direction with the tips of brushes kept into contact with the raising surface of the fiber web 3. With such a brush belt 4, the fibers outwardly projected by the needle punching are held in the brush of the brush belt 4 stably and uniformly. Therefore, a loop raised layer 6 is formed on the surface facing the brush immediately after the needle punching, and the fibers in the entangled nonwoven fabric are efficiently oriented in the thickness direction. In the present invention, the needle punching mentioned above is referred to as a velour needle punching.

In the present invention, the needle punching is partly performed by the velour needle punching to form the loop raised layer 6 on one hand, and to efficiently orient the microfine fiber-forming fibers in the fiber web to the thickness direction on the other hand. Therefore, a usual needle punching using a metal plate having perforated holes for allowing the needles to pass through (bed plate) instead of the brush belt may be conducted before or after the velour needle punching. The fiber web may be punched by a similar velour needle punching also from the side of the loop raised surface. The loop raised surface after the velour needle punching may be further punched by a usual needle punching or the velour needle punching so as to return the raised fibers to the nonwoven fabric, thereby obtaining a nonwoven fabric with more densely entangled fibers. If the fiber web is punched by the velour needle punching from its both sides, the loop raised fibers formed in the first velour needle punching are returned to the nonwoven fabric and oriented in the thickness direction therein by the next velour needle punching. Thus, a nonwoven fabric having the fibers well oriented in the thickness direction can be efficiently obtained.

The shape of needle suitably used in the velour needle punching is selected from known felt needles as long as the needle is not broken and the fibers are not damaged. The number of barbs is preferably 1 to 9. A crown needle having three barbs at three vertexes of triangle blade cross section from the same distance from the tip of needle is preferably used because more fibers are oriented in the thickness direction by a small number of punching. To hold the fibers which project from the surface opposite to the punching surface by punching the needles with such a shape in the brushes on the brush belt which comes into contact with the opposite surface, the first barb from the tip of the needle is required to pass through the fiber web and come into the inside of the brush. To hold the projecting fibers stably, the punching depth is selected so as to allow the first barb to reach the depth of 3 mm or more, preferably 5 mm or more from the tip of the brush.

The density of velour needle punching, i.e., the number of punching the needles per unit area (P/cm$^2$), is determined by the number of needles per unit area of the needle board and the number of punching the needles to the fiber web. The number of punching is preferably selected from 200 to 1000 P/cm$^2$ according to the fineness of fibers in the fiber web to be treated, the mass per unit area of the fiber web, the shape of needle to be used, the intended properties and apparent density of the entangled nonwoven fabric, and the degree of the orientation of the fibers in the thickness direction. Within the above range, the degree of orientation of fibers intended in the present invention is easily obtainable, and the formation of geometric pattern, i.e., needle mark due to many fine holes caused by punched needles is prevented. It is also preferred to select the needle shape which hardly cause the needle mark.

In case of using a usual needle punching which uses a bed plate in place of the brush belt in combination with the velour needle punching, the punching conditions such as the shape of needle, the punching depth, the punching density, and the selection of the surface to be treated are selected from the conditions generally employed in the known methods as long as the entangled nonwoven fabric and the orientation of fibers mentioned below are obtained. In addition, before or after the velour needle punching, a water jet treatment is preferably conducted in place of a usual needle punching as a part of the entangling treatment because the fibers are hardly broken.

The apparent density of the entangled nonwoven fabric thus obtained is preferably 0.1 to 0.6 g/cm$^3$. To obtain a flexibility resembling natural sheep leathers intended in the present invention, the apparent density of the entangled nonwoven fabric is generally preferred as low as possible. However, within the above range, the uneven structure of the nonwoven fabric is prevented and the quality on the surface direction is prevented from being made excessively uneven. Also, a substrate for artificial leathers having good properties and hand can be obtained. It is preferred to obtain a dense fiber entangled structure, which is not attained only by the entangling treatment, by heat treating the entangled nonwoven fabric in the manner described below so as to allow the entangled nonwoven fabric to areal shrink due to the shrinking properties of fibers. To obtain a uniform, dense fiber entangled structure by such a treatment, the apparent density is preferably in the above range. The apparent density is more preferably 0.1 to 0.4 g/cm$^3$, and still more preferably 0.13 to 0.2 g/cm$^3$. The apparent density referred herein is determined by calculating the mass per unit area from the measured mass of the entangled nonwoven fabric having a given surface area, separately measuring the thickness of the entangled nonwoven fabric under a load of 0.7 gf/cm$^2$, and then dividing the mass per unit area by the thickness.

It is also preferred to densify the entangled nonwoven fabric after the velour needle punching or the areal shrinking treatment by heat-shrinking with hot water or steam, thereby increasing the density of the fibers oriented to the thickness direction of the nonwoven fabric. Particularly, when the microfine fiber-forming fibers are sea-island composite fibers containing the PVA-based resin as the sea component, the entangled nonwoven fabric is preferably heat-shrunk at a relative humidity of 75 to 95% after added with 5% by mass or more of water based on the PVA-based resin. More preferably, the heat shrinking is conducted at a relative humidity of 90 to 95% after adding 10% by mass or more water based on the PVA-based resin. The shrinking treatment is preferably conducted at an ambient temperature of 60 to 95° C. because the control by apparatus is easy and the microfine fiber-forming fibers are highly shrunk. If the water is added 5% by mass or more, the sea component (PVA-based resin) of the microfine fiber-forming fibers is sufficiently plasticized and the island component is sufficiently shrunk. If the relative humidity is 75% or more, the sea component is prevented from being hardened due to rapid evaporation of water, to ensure a sufficient shrinking. The upper limit of the amount of water to be added is not critical, and preferably 50% by mass or less of the PVA-based resin in view of preventing the contamination of the process line due to eluted PVA-based resin and enhancing the drying efficiency. The amount of water to be added herein referred to is based on the amount of the PVA-based resin in the entangled nonwoven fabric which is kept under the standard state (23° C., 65% RH) for 24 h.

The addition of water is conducted by a method of sprinkling water onto the entangled nonwoven fabric, a method of providing steam or mist of water droplets to the entangled nonwoven fabric, or a method of applying water onto the surface of the entangled nonwoven fabric, with the method of providing steam or mist of water droplets to the entangled nonwoven fabric being particularly preferred. It is preferred that the water to be added has a temperature substantially not dissolving PVA-based resin. The heat shrinking treatment may be conducted at a relative humidity of 75% or more after adding water to the entangled nonwoven fabric or may be conducted simultaneously with the addition of water. During the heat shrinking treatment, the entangled nonwoven fabric is kept in the above atmosphere without tension as much as possible. The heat shrinking time is preferably 1 to 5 min in view of the productivity and a sufficient shrinking. In the present invention, by the velour needle punching, the dense entangled nonwoven fabric having the fibers little damaged and highly oriented to the thickness direction is obtained. Therefore, there is no disadvantage in the handling and process passing properties in the subsequent steps and a substrate for artificial leathers having a sufficient strength is obtained even if the shrinking treatment is omitted. Thus, there is no limitation for the lower limit of the areal shrinkage, and the upper limit is preferably about 60% in view of uniform shrinking. The entangled nonwoven fabric may be pressed when the remaining PVA-based resin is still in the plasticized or melted state, to smoothen the surface or adjust the apparent density.

After the optional shrinking treatment or surface smoothening treatment, it is preferred to impregnate the entangled nonwoven fabric with a solution or emulsion of elastic polymer, coagulating the impregnated elastic polymer, and convert the microfine fiber-forming fibers such as sea-island composite fibers to bundles of microfine fibers by removing one of their components, thereby obtaining the substrate for artificial leathers. The impregnation and coagulation of the elastic polymer may be performed after converting the microfine fiber-forming fibers to microfine fibers. This method is advantageous in view of enhancing the shape stability of the substrate for artificial leathers by a small amount of the elastic polymer, because the elastic polymer and the microfine fibers are well adhered to each other.

In a method of impregnating and coagulating the elastic polymer, an organic solution of the elastic polymer is impregnated into the entangled nonwoven fabric and then the impregnated elastic polymer is wet-coagulated by treating with its non-solvent. In this method, the coagulated elastic polymer forms a continuous foamed structure. Therefore, a shape stability and a hand resembling natural leathers are obtained by a small amount of the elastic polymer, although insufficient in dense feeling. Also, a substrate for artificial leathers which combines fine buckling wrinkles, non-repulsive softness and firm hand is obtained by the use of a small amount of the elastic polymer.

Generally, when an aqueous emulsion of the elastic polymer is used, a large amount of resin is required to obtain a continuous structure of the coagulated elastic polymer, to result in a hard hand. However, in the present invention, since the fibers highly oriented to the thickness direction fastens, in place of the elastic polymer, the top and back surfaces of the nonwoven fabric, fine buckling wrinkles are easily formed even if the elastic polymer is used in a small amount. In addition, the use of a small amount of the elastic polymer provides a substrate for artificial leathers which combines the non-repulsive softness and firm hand.

The method of providing the aqueous emulsion of the elastic polymer is not specifically limited and a known method such as immersion method, spray method and application method is employed. For example, a method in which an aqueous emulsion is applied to the surface opposite to the dense surface of the entangled nonwoven fabric and allowed to impregnate thereinto is preferably used because a surface free from the elastic polymer is obtained. The impregnated elastic polymer is coagulated by a wet method such as a hot water treatment at 70 to 100° C. and a steam treatment at 100 to 200° C. or a dry method such as a heat treatment in a dryer at 50 to 200° C., preferably by the dry method. The concentration of the elastic polymer in the aqueous emulsion is preferably 3 to 40% by mass.

The amount (solid basis) of the elastic polymer to be impregnated is preferably 1 to 40% by mass and more preferably 3 to 25% by mass based on the mass of the nonwoven fabric after the conversion into microfine fibers. Within the above range, the microfine fibers (fiber bundles) are sufficiently fixed to obtain fine buckling wrinkles, a good shape stability and a good surface smoothness. In addition, a low repulsive flexibility resembling natural leathers is obtained without hardening the hand, while preventing the elastic properties of the elastic polymer from being actualized.

Examples of the elastic polymer include synthetic resins such as polyvinyl chloride, polyamide, polyester, polyester-ether copolymer, polyacrylic ester copolymer, polyurethane, neoprene, styrene-butadiene copolymer, silicone resin, polyamino acid and polyamino acid-polyurethane copolymer, natural high molecular resin, and mixtures thereof. If necessary, a pigment, a dye, a crosslinking agent, a filler, a plasticizer, a stabilizer, etc. may be added. Since a soft hand is obtained, polyurethane or a mixture of polyurethane and another resin is preferably used.

After impregnating, coagulating and drying the emulsion, the microfine fiber-forming fibers are converted to bundles of microfine fibers by removing the removable component such as PVA-based resin by the extraction with water. The extractive removal is performed using a dyeing machine such as a jet dyeing machine and a jigger, or a scouring machine such as an open soaper, although not limited thereto. The water temperature in the extraction bath is preferably selected from the range of 80 to 95° C. and the extraction time is preferably selected from the range of 5 to 120 min according to the density of the nonwoven fabric and the proportion of the components in the microfine fiber-forming fibers. It is preferred to remove the most or all the removable component by repeating the immersion of the nonwoven fabric impregnated with the elastic polymer in the extraction bath and the subsequent squeeze of water.

The average single fiber fineness of the microfine fibers thus obtained is preferably 0.0003 to 0.5 dtex, more preferably 0.005 to 0.35 dtex, and still more preferably 0.01 to 0.2 dtex. If being 0.0003 dtex or more, the unfavorable densification due to the collapse of nonwoven fabric structure is prevented, to obtain a light-weight, soft substrate for artificial leathers. In addition, the suede-finished artificial leathers produced from such a substrate for artificial leathers have a good color development. If being 0.5 dtex or less, a substrate for artificial leathers having a non-repulsive flexibility and a grain-finished artificial leather having a surface smoothness and fine buckling wrinkles can be obtained. In addition, a suede-finished artificial leather having a grace raised surface, a soft touch and a good nubuck appearance can be obtained. The fineness of the bundles of microfine fibers is generally 0.25 to 5 dtex and each bundle generally contains 4 to 10000 microfine fibers.

The apparent density of the substrate for artificial leathers thus produced is preferably 0.35 to 0.65 g/cm$^3$ and more preferably 0.40 to 0.55g/cm$^3$, because a dense feeling and good flexibility resembling natural leathers are simultaneously realized.

As described above, in the present invention the fibers are highly oriented to the thickness direction by the velour needle punching. With such orientation of the fibers, the nonwoven fabric is densified, and simultaneously, an effect similar to filling a continuous elastic polymer is obtained. The effect of the velour needle punching is particularly remarkable in case of entangling a long fiber nonwoven fabric. When crimped short fibers are used, the orientation of the fibers to the thickness direction which is obtained by the needle punching is kept by the resistance due to the crimps. In contrast, since long fibers are crimp-less and straight, the resistance between the fibers is small. Therefore, the orientation of long fibers to the thickness direction is somewhat difficult to keep. However, by effectively holding the long fibers which project from the surface of nonwoven fabric in the brush on the brush belt in the needle punching operation, the orientation of the long fibers to the thickness direction of the nonwoven fabric is kept effectively. Generally, when long fibers are used, the long fibers are less loosened in the nonwoven fabric because of their continuity, to likely form coarse buckling wrinkles. However, since the fiber bundles are highly oriented to the thickness direction by the velour needle punching and the top and back surfaces are deformed in a similar manner, the formation of coarse buckling wrinkles are effectively reduced. In addition, even if the amount of the elastic polymer to be impregnated into the entangled nonwoven fabric is small, the formation of coarse buckling wrinkles are effectively reduced.

The above effect can be achieved by the fiber orientation characterized by the following requirements 1 and 2 which are obtained by the entangling treatment by the velour needle punching.

Requirement 1

The number of the fiber bundles oriented to the thickness direction of the nonwoven fabric constituting the substrate for artificial leathers is 75 to 300, preferably 100 to 270, and more preferably 120 to 250 per 1 cm of width which is perpendicular to the thickness direction (parallel to the surface of the substrate for artificial leathers) when measured on arbitrary cross section parallel to the thickness direction.

By meeting the requirement 1, a grain-finished artificial leather having fine buckling wrinkles and a suede-finished artificial leather having a suede appearance with a surface touch of fine texture and a grace writing effect or a good nubuck appearance are obtained. Also, a non-repulsive softness and a firm hand which resemble those of natural sheep leathers can be attained.

Requirement 2

The number of the cross sections of the fiber bundles oriented to the thickness direction of the nonwoven fabric is 30 to 800, preferably 100 to 750 and more preferably 150 to 700 per 1 mm$^2$ when measured on an arbitrary cross section perpendicular to the thickness direction (parallel to the surface of the substrate for artificial leathers).

By meeting the requirement 2, a grain-finished artificial leather having fine buckling wrinkles and a suede-finished artificial leather having a suede appearance with a surface touch of fine texture and a grace writing effect or a good nubuck appearance are obtained. Also, a non-repulsive softness and a firm hand which resemble those of natural sheep leathers can be attained.

If only the requirement 1 is satisfied, a grain-finished artificial leather and a suede-finished artificial leather each having a uniform surface appearance (fine buckling wrinkles and a surface touch with fine texture) are difficult to obtain. Namely, the effect of the present invention is stably obtained by also meeting the requirement 2 at the same time. The converse is also true. Thus, to obtain the effect of the present invention, both the requirements 1 and 2 should be satisfied.

The nonwoven fabric having the structure satisfying the requirements 1 and 2 is obtained by the entangling treatment including the velour needle punching mentioned above. Such structure cannot be obtained by only a usual needle punching which uses a bed plate in place of the brush belt. As described above, the orientation of the fibers to the thickness direction achieved by the velour needle punching can be effectively kept. Therefore, by using needles which little cause fiber damage and fiber break and by needle punching under mild conditions such as a relatively small punching number, an extremely high degree of orientation to the thickness direction is obtained as compared with the usual needle punching.

Since the fiber break during the entangling treatment of fiber web is minimized, the average number of broken ends of microfine fiber-forming fibers on the surface of the entangled nonwoven fabric is as low as 5/mm$^2$ or less (inclusive of zero), thereby enhancing the tenacity and elongation of the resultant substrate for artificial leathers. To further improve the mechanical properties of the substrate for artificial leathers, the number of broken ends is preferably 4/mm$^2$ or less. By controlling the break of the microfine fiber-forming fibers in the manner described above, a substrate for artificial leathers having a surface in which the number of broken ends of fiber bundles is 5/mm$^2$ or less, preferably 4/mm$^2$ or less (each inclusive of zero) can be obtained.

The substrate for artificial leathers thus produced is made into a grain-finished or semi-grain-finished artificial leather by applying a resin for a surface coating layer and subjecting to a treatment such as embossing, softening and dyeing, or by heat-melting the surface to smoothen the surface, each being conducted by a known method under desired conditions. A suede-finished or nubuck artificial leather is obtained by raising the surface to form a napped surface and then optionally subjecting to a softening treatment and a dyeing treatment. The surface may be raised by a known method, preferably by buffing with a sand paper or a card clothing. These artificial leathers combine a non-repulsive softness and firm hand resembling natural leathers, fine buckling wrinkles and drapeability attributable to long fibers, and therefore, suitable as the materials for the products such as clothes, shoes, glove, baseball gloves, belts, balls and interior furniture such as sofa.

EXAMPLES

The present invention will be described in more detail with reference to the examples. However, it should be noted that the scope of the present invention is not limited thereto. The "part(s)" and "%" used in the examples are based on the mass unless otherwise noted. Each measuring result was obtained by the following method. The results are expressed by an average of five measured values unless otherwise noted.

(1) Average Fineness of Fibers

Calculated from the Density of the Resin Constituting the Fibers and the cross-sectional area of the fibers determined by a scanning electron photomicrograph (×few hundreds to few thousands).

(2) Melting Point of Resin

Using DSC (TA3000 manufactured by Mettler Co. Ltd.), the sample was heated to 300° C. at a temperature rising rate of 10° C./min in nitrogen atmosphere, cooled to room temperature, and then, heated again to 300° C. at a temperature rising rate of 10° C./min. The peak top temperature of the obtained endothermic curve is taken as the melting point.

(3) Number of Fiber Bundles Oriented to Thickness Direction on Cross Section Parallel to Thickness Direction Electron photomicrographs (×60) of an arbitrary cross section parallel to the thickness direction of the nonwoven fabric constituting the substrate for artificial leathers were taken at 10 continuous portions. On a photomicrograph magnified by 500%, the number of fiber bundles per 1 cm width which was perpendicular to the thickness direction (number of fiber bundles intersecting 1 cm line segment) was visually counted and an average of 10 portions was obtained by calculation. FIG. 1 is an electron photomicrograph of a cross section parallel to the thickness direction of the substrate for artificial leathers obtained in Example 1. In FIG. 1, reference numeral 1 indicates the fiber bundles oriented to the thickness direction.

Figure 2:
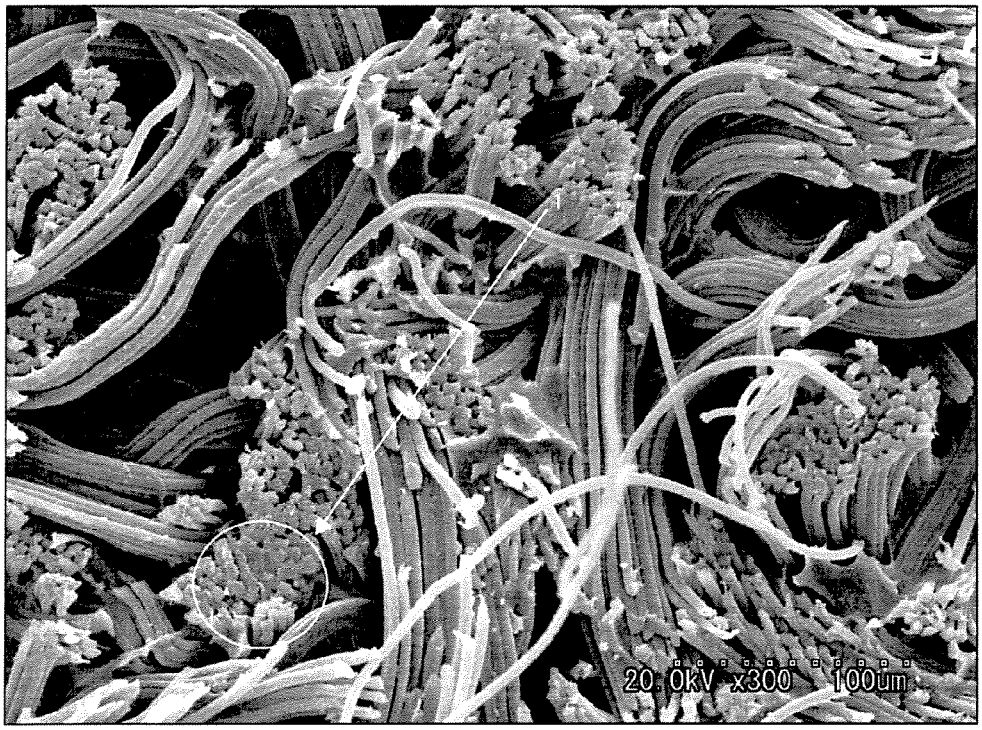
FIG. 2 is an electron photomicrograph (×300) of a cross section which is taken along a direction perpendicular to the thickness direction of a grain-finished artificial leather made of the substrate for artificial leathers of the invention, showing the orientation of the fiber bundles in the nonwoven fabric to the thickness direction.

(4) Number of Fiber Bundles Oriented to Thickness Direction on Cross Section Perpendicular to Thickness Direction Electron photomicrographs (×300) of an arbitrary cross section perpendicular to the thickness direction of the nonwoven fabric constituting the substrate for artificial leathers (a cross section parallel to the surface of the substrate for artificial leathers) were taken at 10 continuous portions. On a photomicrograph magnified by 500%, the number of the cross sections of fiber bundles per 1 mm$^2$ was visually counted and an average of 10 portions was obtained by calculation. FIG. 2 is an electron photomicrograph of a cross section perpendicular to the thickness direction of the substrate for artificial leathers obtained in Example 1. In FIG. 2, the circular portion indicated by reference numeral 1 is the cross section of the fiber bundles oriented to the thickness direction.

(5) Number of Broken Ends on Surface of Entangled Nonwoven Fabric

Electron photomicrographs (×100) of the surface of nonwoven fabric were taken at 10 continuous portions. On a photomicrograph magnified by 500%, the number of broken ends of microfine fiber-forming fibers per 1 mm$^2$ was visually counted and an average of 10 portions was obtained by calculation.

(6) Hand

The hand of a sample (grain-finished artificial leather) was evaluated by five panelists according to the following ratings:

A: soft and non-repulsive hand

B: soft but repulsive hand

C: hard and repulsive hand (7) Buckling Wrinkles

A 4 cm×4 cm sample (grain-finished artificial leather) was clipped along two lengthwise sides (or two widthwise sides) at 1 cm inside from the edges. Then, the interspace between two clipped portions was narrowed from 2 cm to 1 cm so as to allow the grain surface to bend inside. Thereafter, the number of buckling wrinkles formed on the grain surface was visually counted and evaluated according to the following ratings.

A: zero to two buckling wrinkles

B: 3 to 4 buckling wrinkles

C: 5 to 7 buckling wrinkles

D: 8 buckling wrinkles or more

Production Example 1

Production of Water-soluble, Thermoplastic Polyvinyl Alcohol-based Resin

A 100-L pressure reactor equipped with a stirrer, a nitrogen inlet, an ethylene inlet and an initiator inlet was charged with 29.0 kg of vinyl acetate and 31.0 kg of methanol. After raising the temperature to 60° C., the reaction system was purged with nitrogen by bubbling nitrogen for 30 min. Then, ethylene was introduced so as to adjust the pressure of the reactor to 5.9 kgf/cm$^2$. A 2.8 g/L methanol solution of 2,2'-azobis(4-methoxy-2,4-dimethylvaleronitrile) was purged with nitrogen by nitrogen gas bubbling. After adjusting the temperature of reactor to 60° C., 170 mL of the initiator solution was added to initiate the polymerization. During the polymerization, the pressure of reactor was maintained at 5.9 kgf/cm$^2$ by introducing ethylene, the polymerization temperature was maintained at 60° C., and the initiator solution was continuously added at a rate of 610 mL/h. When the conversion of polymerization reached 70% after 10 h, the polymerization was terminated by cooling.

After releasing ethylene from the reactor, ethylene was completely removed by bubbling nitrogen gas. The non-reacted vinyl acetate monomer was removed under reduced pressure to obtain a methanol solution of polyvinyl acetate, which was then diluted to 50% concentration with methanol. To 200 g of the 50% methanol solution of polyvinyl acetate (100 g of polyvinyl acetate in the solution), 46.5 g of a 10% methanol solution of NaOH was added. The molar ratio of NaOH/vinyl acetate unit was 0.10. After about 2 min of the addition of the alkali solution, the system was gelated. The gel was crushed by a crusher and allowed to stand at 60° C. for one hour to allow the saponification to further proceed. Then, 1000 g of methyl acetate was added. After confirming the completion of neutralization of the remaining alkali by phenolphthalein indicator, white solid (modified PVA) was separated by filtration. The white solid (modified PVA) was added with 1000 g of methanol and allowed to stand at room temperature for 3 h for washing. After repeating the above washing operation three times, the liquid was centrifugally removed and the solid remained was dried at 70° C. for 2 days to obtain a dried modified PVA.

The saponification degree of the ethylene-modified PVA was 98.4 mol %. The modified PVA was incinerated and dissolved in an acid for analysis by atomic-absorption spectroscopy. The content of sodium was 0.03 part by mass based on 100 parts by mass of the modified PVA. After repeating three times the reprecipitation-dissolution operation in which n-hexane is added to the methanol solution of polyvinyl acetate obtained by removing the non-reacted vinyl acetate monomer after the polymerization to cause precipitation and acetone is then added for dissolution, the precipitate was vacuum-dried at 80° C. for 3 days to obtain a purified polyvinyl acetate. The polyvinyl acetate was dissolved in d6-DMSO and analyzed by 500 MHz H-NMR (JEOL GX-500) at 80° C. The content of ethylene unit was 10 mol %.

The above methanol solution of polyvinyl acetate was added with a 10% methanol solution of NaOH. The molar ratio of NaOH/vinyl acetate unit was 0.5. The resultant gel was crushed and the saponification was allowed to further proceed by standing at 60° C. for 5 h. The saponification product was extracted by Soxhlet with methanol for 3 days and the obtained extract was vacuum-dried at 80° C. for 3 days to obtain a purified, ethylene-modified PVA. The average polymerization degree of the purified, modified PVA was 330 when measured by a method of JIS K6726. The content of 1,2-glycol linkage and the content of three consecutive hydroxyl groups in the purified, modified PVA were respectively 1.50 mol % and 83% when measured by 5000 MHz H-NMR (JEOL GX-500). A 5% aqueous solution of the purified, modified PVA was made into a cast film of 10 μm thick, which was then vacuum-dried at 80° C. for one day and then measured for the melting point in the manner described above. The melting point was 206° C.

Example 1

The water-soluble, thermoplastic PVA (ethylene-modified PVA, sea component) produced above and an isophthalic acid-modified polyethylene terephthalate (degree of modification of 6 mol %, island component) were extruded at 260° C. form a spinneret for melt composite spinning (number of islands: 25 per one microfine fiber-forming fiber) in a sea component/island component ratio of 30/70 (by mass). The ejector pressure was regulated such that the spinning speed was 4500 m/min. The long fibers were collected on a net, to obtain a long fiber web having a mass per unit area of 30 g/m$^2$ which was composed of microfine fiber-forming fibers having an average fineness of 2.0 dtex.

A superposed body of 12 long fiber webs prepared by crosslapping was sprayed with an oil agent for preventing needle break, and then, subjected to a velour needle punching from both sides at a total density of 500 punch/cm$^2$ and a punching depth of 10 mm using crown needles (tip-to-barb distance: 3 mm; throat depth: 0.06 mm). Thereafter, the superposed body was subjected to a needle punching alternately from both sides at a density of 1000 punch/cm$^2$ and a punching depth of 8 mm using single-barb needles (tip-to-barb distance: 3 mm; throat depth: 0.04 mm), to obtain an entangled nonwoven fabric of long fibers.

The entangled nonwoven fabric of long fibers was added with 30% by mass of water based on the amount of PVA and heat-treated at a relative humidity of 95% and 70° C. for 3 min by standing under stress-free conditions. The entangled nonwoven fabric shrunk by the heat treatment at an areal shrinkage of 45% to increase the apparent density, to obtain a densified nonwoven fabric. The densified nonwoven fabric was pressed by a hot roll, to obtain a nonwoven fabric with a smooth surface, which had a mass per unit area of 740 g/m$^2$ and an apparent density of 0.50 g/cm$^3$.

The nonwoven fabric was impregnated with an aqueous polyurethane emulsion ("Super Flex E-4800" manufactured by Dai-Ichi Kogyo Seiyaku Co., Ltd.) by immersion, and then, dried and cured at 150° C., to obtain a resin-impregnated nonwoven fabric having an elastic polymer/microfine fiber-forming fibers ratio of 6/94. The resin-impregnated nonwoven fabric was immersed in a hot water of 95° C. to remove PVA by dissolution, thereby obtaining an entangled nonwoven fabric of long microfine fibers (substrate for artificial leathers). The single fiber fineness of the long microfine fibers was 0.1 dtex. To the densified surface of the substrate for artificial leathers, a polyurethane film of 50 μm thick which was prepared on a releasing paper was adhered using a two-part urethane adhesive. After sufficient drying and crosslinking reaction, the releasing paper was removed, to obtain a grain-finished artificial leather which combined a non-repulsive softness and firm hand and had fine buckling wrinkles.

Example 2

The long fiber webs (20 sheets) prepared in Example 1 were superposed by crosslapping and sprayed with an oil agent for preventing needle break, to obtain a superposed body. The superposed body was subjected to a velour needle punching from both sides at a total density of 500 punch/cm$^2$ and a punching depth of 10 mm using crown needles (tip-to-barb distance: 3 mm), and then, subjected to a needle punching alternately from both sides at a density of 1000 punch/cm$^2$ and a punching depth of 8 mm using single-barb needles (tip-to-barb distance: 3 mm), to obtain an entangled nonwoven fabric of long fibers.

The entangled nonwoven fabric of long fibers was pressed by a hot roll, to obtain a nonwoven fabric with a smooth surface, which had a mass per unit area of 670 g/m$^2$ and an apparent density of 0.45 g/cm$^3$. The nonwoven fabric was impregnated with an aqueous polyurethane emulsion ("Super Flex E-4800" manufactured by Dai-Ichi Kogyo Seiyaku Co., Ltd.) by immersion, and then, dried and cured at 150° C., to obtain a resin-impregnated nonwoven fabric having an elastic polymer/microfine fiber-forming fibers ratio of 18/82. The resin-impregnated nonwoven fabric was immersed in a hot water of 95° C. to remove PVA by dissolution, thereby obtaining an entangled nonwoven fabric of long microfine fibers (substrate for artificial leathers). The single fiber fineness of the long microfine fibers was 0.08 dtex. To the densified surface of the substrate for artificial leathers, a polyurethane film of 50 μm thick which was prepared on a releasing paper was adhered using a two-part urethane adhesive. After sufficient drying and crosslinking reaction, the releasing paper was removed, to obtain a grain-finished artificial leather which combined a non-repulsive softness and firm hand and had fine buckling wrinkles.

Example 3

The surface of the substrate for artificial leathers prepared in Example 1 was raised by a sand paper, to obtain a suede-finished artificial leather which combined a non-repulsive softness and firm hand and had a surface touch with fine texture and a grace writing effect.

Comparative Example 1

A grain-finished artificial leather was produce in the same manner as in Example 1 except for entangling the long fiber webs only by a needle punching alternately from both sides at a density of 3000 punch/cm$^2$ and a punching depth of 8 mm using single-barb needles (tip-to-barb distance: 3 mm; throat depth: 0.04 mm) without employing the velour needle punching. The grain-finished artificial leather had a good hand, but easily formed buckling wrinkles and had a poor dense feeling.

Comparative Example 2

A grain-finished artificial leather was produce in the same manner as in Example 2 except for entangling the long fiber webs only by a needle punching alternately from both sides at a density of 3000 punch/cm$^2$ and a punching depth of 8 mm using single-barb needles (tip-to-barb distance: 3 mm; throat depth: 0.04 mm) without employing the velour needle punching. The grain-finished artificial leather had a good hand, but easily formed buckling wrinkles and had a poor dense feeling.

Comparative Example 3

A grain-finished artificial leather was produce in the same manner as in Example 1 except for entangling the long fiber webs only by a needle punching alternately from both sides at a density of 3000 punch/cm$^2$ and a punching depth of 8 mm using 9-barb needles (tip-to-barb distance: 3 mm; throat depth: 0.08 mm) without employing the velour needle punching. The entangled nonwoven fabric after the needle punching had an appearance with remarkable needle holes, a fluffing surface due to fiber damages and a poor smoothness. The specific gravity was unfavorably as high as 0.24. The grain-finished artificial leather obtained had a hard hand, easily formed buckling wrinkles and had a poor dense feeling.

The results of Examples 1-2 and Comparative Examples 1-3 are shown in Table 1.

TABLE 1

| | Examples | | Comparative Examples | | |
|---|---|---|---|---|---|
| | 1 | 2 | 1 | 2 | 3 |
| Number of broken ends per mm$^2$ | 4 | 3 | 2 | 3 | 36 |
| Number of fiber bundles per cm | 227 | 161 | 37 | 18 | 58 |
| Number of cross sections per mm$^2$ | 569 | 481 | 13 | 12 | 17 |
| Substrate for artificial leathers | | | | | |
| thickness (mm) | 1.34 | 1.29 | 1.41 | 1.33 | 1.23 |
| apparent density (g/cm$^3$) | 0.49 | 0.45 | 0.51 | 0.44 | 0.58 |

TABLE 1-continued

| | Examples | | Comparative Examples | | |
|---|---|---|---|---|---|
| | 1 | 2 | 1 | 2 | 3 |
| Grain-finished artificial leathers | | | | | |
| hand | A | A | B | B | C |
| buckling wrinkles | A | B | D | D | D |

INDUSTRIAL APPLICABILITY

The substrate for artificial leathers of the present invention is produced from various combinations of microfine fibers and elastic polymers and suitable for the production of a grain-finished artificial leather which combines a non-repulsive softness and firm hand each resembling those of tanned natural sheep leathers and has fine buckling wrinkles and a suede-finished or nubuck artificial leather which has a surface touch with fine texture and a grace writing effect each being hitherto not obtained. The artificial leathers produced from the substrate for artificial leathers of the present invention are applied to leather-like products such as shoes, game balls, furniture, seats for vehicles, clothes, gloves, baseball gloves, briefcases, belts and handbags.

What is claimed is:

1. A substrate for artificial leathers which comprises a nonwoven fabric made of fiber bundles of microfine fibers having an average single fiber fineness of 0.5 dtex or less and an elastic polymer impregnated into the nonwoven fabric, the substrate satisfying the following requirements 1 and 2:

(1) the number of fiber bundles which are oriented to a thickness direction of the nonwoven fabric is 75 to 300 per 1 cm of width which is perpendicular to the thickness direction, when measured on a cross section parallel to the thickness direction; and (2) the number of cross sections of the fiber bundles which are oriented to the thickness direction is 30 to 800 per 1 mm$^2$, when measured on a cross section perpendicular to the thickness direction.

2. The substrate for artificial leathers according to claim 1, wherein the microfine fibers are long fibers.

3. The substrate for artificial leathers according to claim 2, further satisfying the following requirement 3:

(3) the number of broken ends of the fiber bundles on a surface of the nonwoven fabric is 4/mm$^2$ or less.

4. The substrate for artificial leathers according to claim 1, wherein the elastic polymer is formed by impregnating an aqueous emulsion of the elastic polymer and then coagulating the aqueous emulsion.

5. The substrate for artificial leathers according to claim 1, wherein the fiber bundles of the microfine fibers are formed from microfine fiber-forming fibers which contains a water-soluble, thermoplastic polyvinyl alcohol-based resin as one of components by removing the water-soluble, thermoplastic polyvinyl alcohol-based resin from the microfine fiber-forming fibers by extraction.

6. The substrate for artificial leathers according to claim 5, wherein the water-soluble, thermoplastic polyvinyl alcohol-based resin has an average polymerization degree of 200 to 500, a saponification degree of 90 to 99.99 mol %, and a melting point of 160 to 230° C.

7. A grain-finished artificial leather which is produced by forming a coating layer on at least one surface of the substrate for artificial leathers according to claim 1.

8. A suede-finished artificial leather which is produced by raising at least one surface of the substrate for artificial leathers according to claim 1.

9. A grain-finished artificial leather which is produced by forming a coating layer on at least one surface of the substrate for artificial leathers according to claim 2.

10. A grain-finished artificial leather which is produced by forming a coating layer on at least one surface of the substrate for artificial leathers according to claim 3.

11. A grain-finished artificial leather which is produced by forming a coating layer on at least one surface of the substrate for artificial leathers according to claim 4.

12. A grain-finished artificial leather which is produced by forming a coating layer on at least one surface of the substrate for artificial leathers according to claim 5.

13. A grain-finished artificial leather which is produced by forming a coating layer on at least one surface of the substrate for artificial leathers according to claim 6.

14. A suede-finished artificial leather which is produced by raising at least one surface of the substrate for artificial leathers according to claim 2.

15. A suede-finished artificial leather which is produced by raising at least one surface of the substrate for artificial leathers according to claim 3.

16. A suede-finished artificial leather which is produced by raising at least one surface of the substrate for artificial leathers according to claim 4.

17. A suede-finished artificial leather which is produced by raising at least one surface of the substrate for artificial leathers according to claim 5.

18. A suede-finished artificial leather which is produced by raising at least one surface of the substrate for artificial leathers according to claim 6.

* * * * *